United States Patent [19]

Lemaire et al.

[11] Patent Number: 4,860,519

[45] Date of Patent: Aug. 29, 1989

[54] MACHINE FOR THE AUTOMATIC PACKAGING OF CONTAINERS

[75] Inventors: Didier Lemaire, Cherisy; Jean-Marc Dronet, Putanges Pont Ecrepin, both of France

[73] Assignee: E.P. Remy & Cie, France

[21] Appl. No.: 188,359

[22] Filed: Apr. 29, 1988

[30] Foreign Application Priority Data

May 12, 1987 [FR] France ..... 87 06661

[51] Int. Cl.[4] ..... B65B 59/04

[52] U.S. Cl. ..... 53/167; 53/282

[58] Field of Search ..... 53/167, 282, 77; 493/181, 479

[56] References Cited

U.S. PATENT DOCUMENTS

| | | | |
|---|---|---|---|
| 1,551,552 | 9/1925 | Furrer . | |
| 3,017,731 | 1/1962 | Lohse | 53/201 |
| 3,368,461 | 2/1968 | Grobman | 493/181 X |
| 3,828,522 | 8/1974 | Ueda | 53/167 |
| 4,012,888 | 3/1977 | Nichols | 53/131 |
| 4,151,698 | 5/1979 | Müller et al. | 53/282 X |
| 4,604,083 | 8/1986 | Barny et al. | 493/479 X |
| 4,759,741 | 7/1988 | Chisholm, Jr. | 493/181 X |

*Primary Examiner*—James F. Coan

*Attorney, Agent, or Firm*—Steinberg & Raskin

[57] ABSTRACT

The present invention concerns a machine for the automatic packaging of goblets, having a number of stations which permit the goblets to be deposited on a conveyor, to be filled, to be obturated and to be evacuated, these stations being each carried by at least one modular frame, all the modular frames being crossed by the conveyor and being likely to be connected to one another by mechanical connecting, each modular frame having mechanical, electrical and pneumatic control associated to each frame to permit the station it carries to work in an autonomous and separate way, these control being possibly connected to and driven by a multiprocessor solid with at least one of the modular frames.

2 Claims, 3 Drawing Sheets

MACHINE FOR THE AUTOMATIC PACKAGING OF CONTAINERS

BACKGROUND OF THE INVENTION

The present invention relates to an automatic machine for packaging containers, such for example as goblets intended to be filled with any foodstuffs.

There has already been known for a long time machines for the automatic packaging of containers which comprise one endless chain conveyor for transporting the containers and upon which are successively disposed a plurality of stations which permit in particular depositing the containers on the conveyor, their filling, their obturation, their marking and their evacuation in order for example to pack the containers into cases.

All the machines of this kind which have been proposed until now are monobloc machines having a number of stations, such as the above-defined stations. However, these machines present drawbacks in that, due to their monobloc construction, they have no flexibility.

More precisely, the user has to be satisfied with the functions originally provided for on the machine and cannot or can only with great difficulty adapt other functions on the machine.

Besides, an immobilization of the machine for a long time is required in order to act upon a station so as to permit this station to be repaired or replaced.

It is to be noted also that the investment for such machines is very high and that it is necessary to renew this investment when it is desired to use other containers, another product for filling these containers, or a treatment for these containers which is somewhat different from the treatment which has been performed by the machine which one owns.

SUMMARY OF THE INVENTION

The present invention has as an object to propose an automatic packaging machine which meets in particular all the abovementioned drawbacks.

For this purpose, the machine according to this invention is of the type comprising at least one conveyor for transporting the container above which are successively disposed various stations which permit in particular the containers to be deposited on the conveyor, to be filled, to be obturated and to be evacuated, and is essentially characterized in that each station forms at least one modular frame all the modular frames being crossed by the conveyor and being likely to be joined together by mechanical connection means, each modular frame having mechanical, electrical, pneumatic or the like control means, associated to each modular frame to permit the station it carries to work in an autonomous and separate way, and the control means being possibly connected and driven by a control means such for example as a multiprocessor solid with one of the modular frames, when these are associated.

Thus, the machine according to this invention may comprise any number of modular frames forming as many partial assemblies which possess a working autonomy and which may be connected to one another to form an assembly controlled by a multiprocessor which drives all the partial assemblies in a synchronized manner.

According to another feature of this machine, each modular frame or partial assembly is substantially in the shape of a rectangular parallelepiped of which both ends may be open and permit respectively having access to the electrical, pneumatic or the like control means, and to the other control means.

According to a preferred embodiment, the mechanical connecting means of the modular frames are formed of cylindrical elements co-operating with openings made in each modular frame.

It is also to be precised here that in particular the mechanical control means housed in each modular frame can be extracted from the frame through sliding or rolling on rails, somewhat in the way of a drawer.

It is seen from the foregoing that it is easy for a user of the machine to replace one modular frame by another or to build himself a machine having any number of modules or partial assemblies, depending on the results to be obtained, it being understood that the combination of the various modules will be able to work immediately owing to the drive and to the synchronization performed by one of the modules comprising the multiprocessor.

BRIEF DESCRIPTION OF THE DRAWINGS

Other advantages and features of the invention will appear more clearly in the course of the following detailed description with reference to the appended drawings, given by way of example only, and wherein.

DESCRIPTION OF THE PREFERRED EMBODIMENTS

According to an embodiment, and referring to the appended drawings, a machine for the automatic packaging of containers, such for example as goblets, according to this invention is formed essentially of partial assemblies or modular frames $B_1, B_2, B_3, \ldots B_n$, each of which carrying one station, as will be described in detail further.

All the modular frames are crossed by a conveyor 1 with endless parallel chains or the like above which are disposed the successive stations carried by the modular frames $B_1, B_2, \ldots B_n$.

Figure 3:
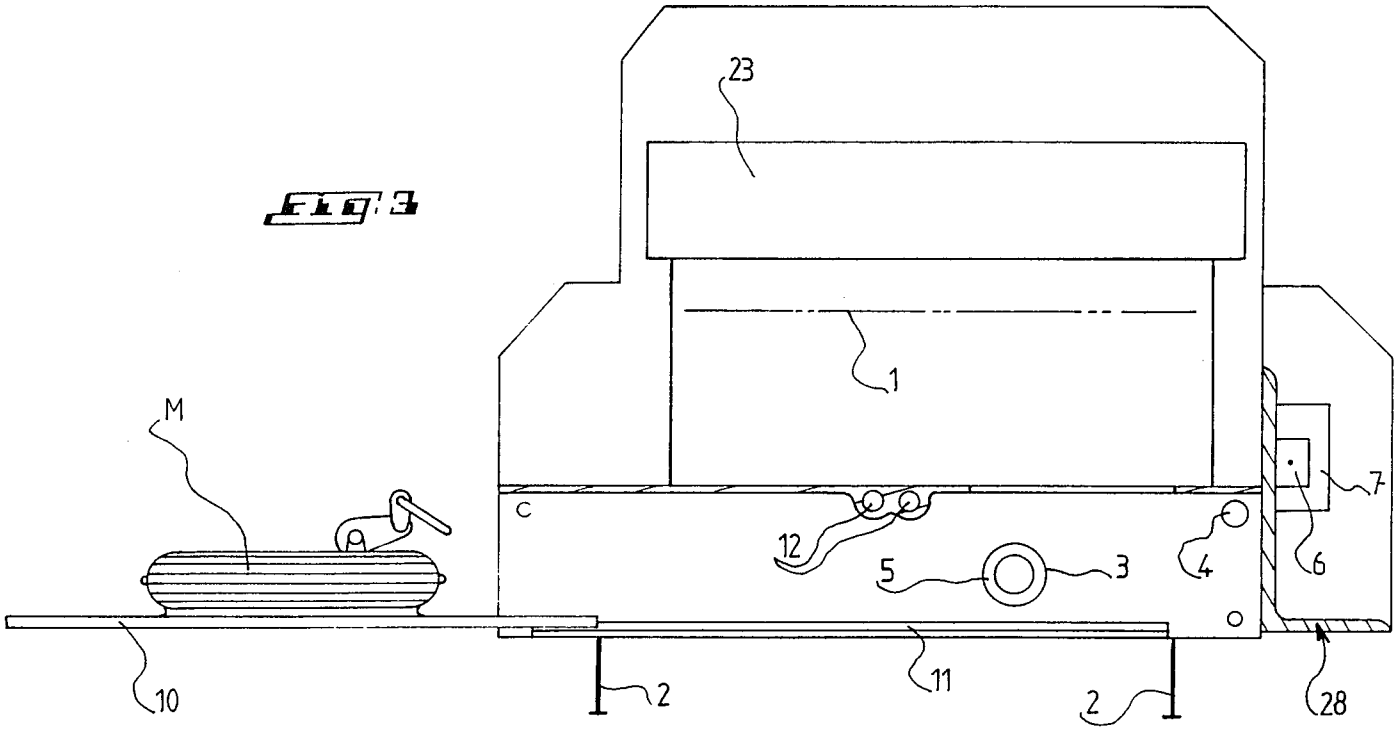
FIG. 3 is a cross-sectional view along line III-III of FIG. 1

The modular frames are each preferably in the shape of a rectangular parallelepiped carried by stands 2 and are connected to one another by mechanical connecting means clearly seen in FIG. 3.

These means are formed for example of centering openings 3 made in the walls of each modular frame, and by apertures 4 which permit the modular frames to be bolt fastened between one another. Cylindrical elements 5 are housed in the openings 3 of the juxtaposed modular frames $B_1 \ldots B_n$ so as to ensure the centering.

Each modular frame has mechanical, electrical, pneumatic or the like control means which permit the station it carries to work in an autonomous and separate manner. These means are diagrammatically shown at 6 in FIG. 2. These means or units 6 can be connected to a multiprocessor 7 so as to be in a condition to work in an autonomous way, while being driven by the multiprocessor 7. It is to be noted here that the modular frames $B_1, B_2, \ldots B_n$ may be disposed successively in any way and in any number, or may even be replaced by one another, and that all these connected frames can be immediately driven in a synchronized manner by the multiprocessor 7 which is therefore in a condition to drive the sequence of the processes to be carried out by the various successive stations carried by the modular frames $B_1$, $B_2$, $B_3 \ldots B_n$.

According to a preferred embodiment, each rectangular parallelepiped forming the modular frames has two ends which can be provided with one door 8, 9.

Figure 1:
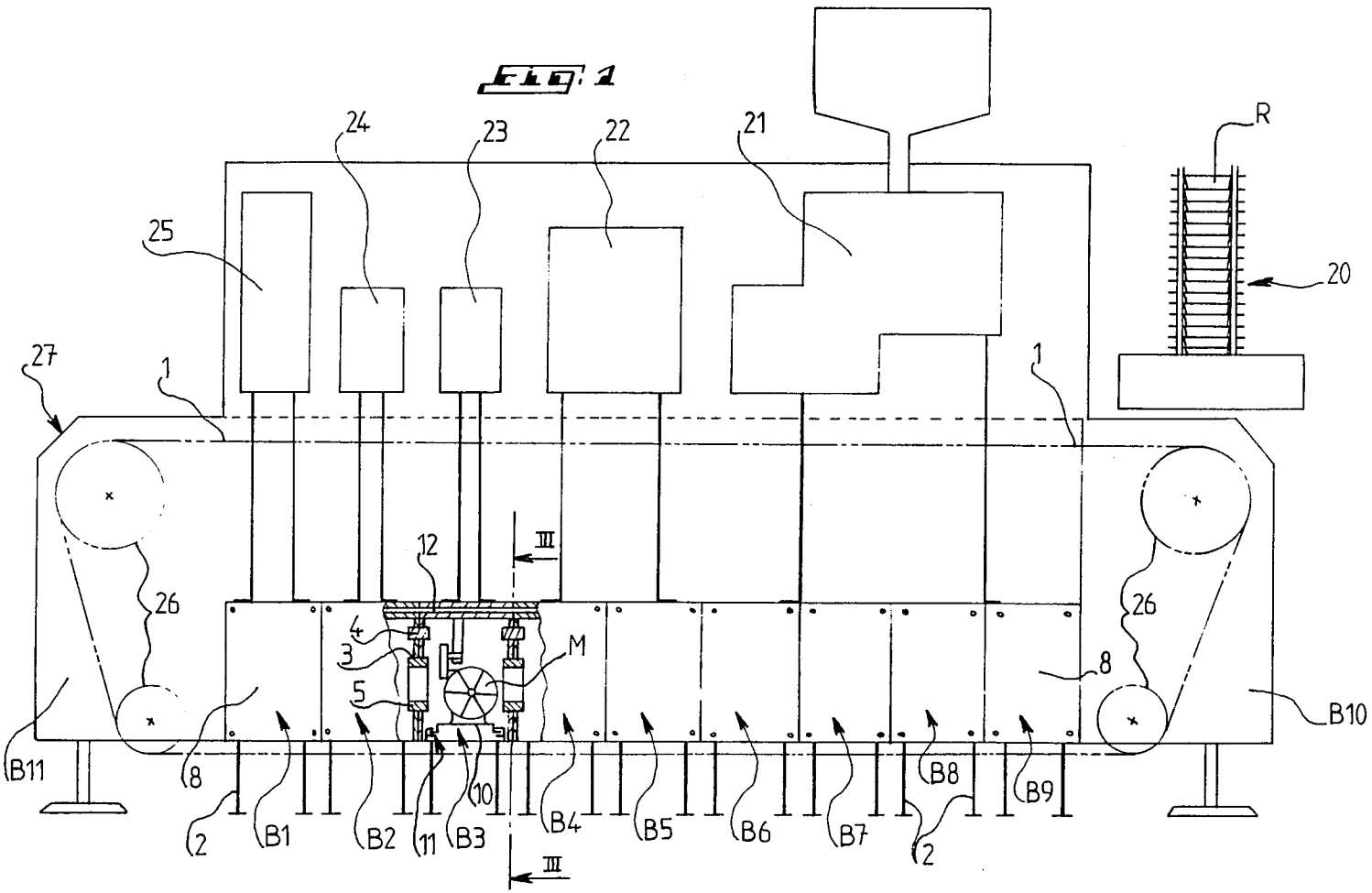
FIG. 1 is a diagrammatic elevational view of a machine according to the principles of the invention.

The doors 8 permit having access to various means for controlling the stations carried by the modular frames and housed inside these frames. Thus, as seen in FIG. 1, these means can for example comprise one motor M which is advantageously mounted on a base 10 which can slide or roll on a rail 11. In other words, as clearly seen in FIG. 3, the motor M can readily be extracted from, or put back into the modular frame $B_3$.

On the other side of each modular frame, the door 9 can be open to have access to the control means or units 6, which permits not only facilitating the actions, but also modifying very easily the electrical, pneumatic or the like connections, in the case where the machine is to be transformed.

Lubrication ducts which pass from one modular frame to another in a continuous manner are shown at 12 in FIGS. 1 and 3.

Figure 2:
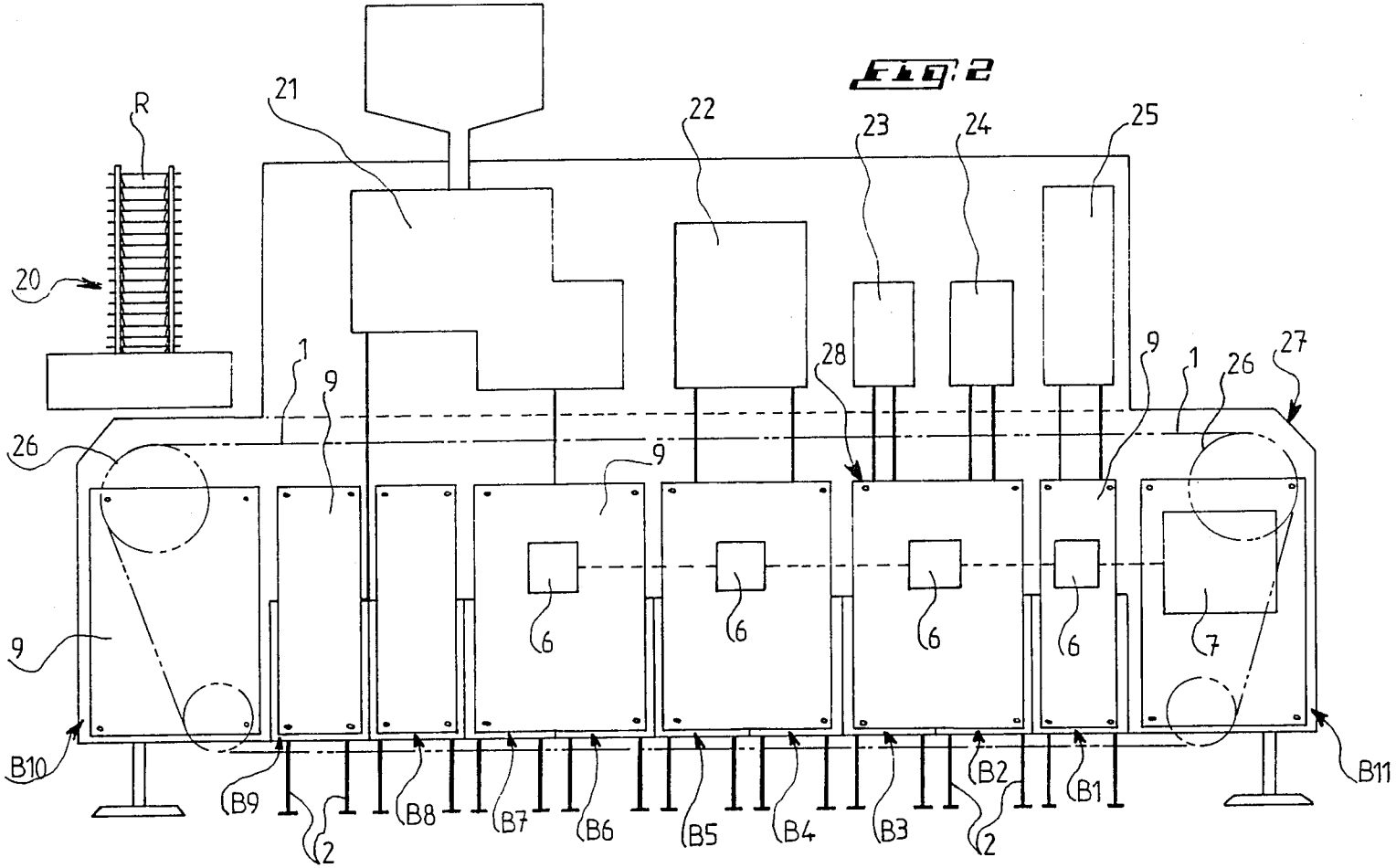
FIG. 2 is also a digrammatic elevational view of this machine on the other side of the same.

According to the embodiment shown in FIGS. 1 and 2, the frame or modular element $B_{10}$ carries one station for taking the containers R out of a pile, and possibly, in the case of a trouble, for putting these containers back on the pile. This station is shown diagrammatically at 20 and comprises the system for stretching the chains of conveyor 1.

Downstream of this station 20, the modular frame $B_9$ is shown as carrying no station. However, it is actually intended to carry a station for sterilizing the containers R with ultraviolet radiation.

Thereafter, the modular frames $B_8$, $B_7$ and $B_6$ carry together one station for filling the containers R, which is diagrammatically shown at 21.

Then, the modular frames $B_5$ and $B_4$ carry together one station for seizing, depositing and transferring lids on the containers R which have been previously filled, this station being diagrammatically shown at 22.

Following this modular element $B_4$, the modular frame $B_3$ carries one station 23 for heat sealing the lids on the containers R.

The modular frame $B_2$ carries one station 24 for marking the containers R, and the modular frame $B_1$ carries one system 25 for removing the containers R towards the packing into cases for example.

Finally, the machine comprises at its end a last module $B_{11}$ which contains the system for actuating the chains of conveyor 1, (which pass around the toothed wheels shown at 26) and which carries the multiprocessor 7.

It is to be added here that a covering which envelops at least partly all the modular frames $B_1 \ldots B_n$ is shown diagrammatically at 27 in FIGS. 1 and 2, it being understood that a hood may cover the stations 21 to 25 at their upper part, which stations are respectively carried by the modules $B_8, \ldots B_1$.

It is still to be added here that the multiprocessor 7 and the electrical and pneumatic control units 6 associated to each modular frame are advantageously fixed on angle irons 28 diagrammatically shown in FIG. 3, which angle irons are fixed on the end of the modular frame which is provided with the door 9.

According to the invention, an automatic packaging machine is provided which can be formed of any number of modular elements, so that said machine presents a remarkable flexibility in that it can readily and immediately adapt to the desired manufacture objectives, it being understood that this machine makes it possible also to readily and immediately replace one modular frame by another in the case of a trouble or of a repair to be made.

Of course, this invention is by no way limited to the embodiment described and shown which has been given by way of example only.

On the contrary, the invention comprises all the technical equivalents of the means described as well as the combinations thereof provided that these are performed according to its spirit.

What is claimed is:

1. A machine for the automatic packaging of containers such as goblets, comprising:

at least one conveyor for transporting said containers;

various stations successfully disposed above said conveyor for at least depositing said containers on the conveyor, filing, obturating and evacuating said containers respectively and successively;

successive modular frames crossed by said conveyor and each supporting one of said successive stations;

openings provided in each modular frame and cylindrical elements inserted into the openings of two successive and juxtaposed modular frames for centering said frames with respect to one another;

apertures provided in each modular frame for allowing said successive modular frames to be interconnected by bolt fastening with one another;

control means associated to and housed in each modular frame for permitting the station supported thereby to work in an autonomous and separate way;

one multiprocessor solid with one of said modular frames and operatively connected to said control means;

lateral door means provided on each said modular frame for providing an access to said control means; and rail means mounted on at least one of said modular frames for slidingly supporting said control means, whereby said control means can be mounted into and extracted from said modular frames through said door means.

2. The combination of claim 1, comprising, in a direction of travel of the containers through the machine, a first frame or modular element carrying said station for taking the containers out of a pile and depositing the same on said conveyor, a second frame or modular element either carrying no station or carrying a station for sterilizing the containers, third, fourth, and fifth frame or modular elements together carrying said station for filling the containers, sixth and seventh frame or modular elements together carrying a station for seizing, depositing and transferring lids onto the respective containers, an eighth frame or modular element carrying sad obturating station for heat sealing the lids on the respective containers, a ninth frame or modular element carrying a station for marking the respective containers, a tenth frame or modular element carrying said evacuating station for removing the containers off said conveyor, and an eleventh frame or modular element carrying a system for actuating chains of said conveyor.

* * * * *